United States Patent [19]

Viganò

[11] 4,205,920

[45] Jun. 3, 1980

[54] APPARATUS FOR CONTINUOUSLY MIXING SAND AND BINDER FOR FOUNDRY USE

[76] Inventor: Luisa Viganò, Via Voldomino, 50/b, Luino, Varese, Italy

[21] Appl. No.: 815,178

[22] Filed: Jul. 13, 1977

[51] Int. Cl.[2] ..... B01F 7/20

[52] U.S. Cl. ..... 366/326; 366/329

[58] Field of Search ..... 259/6, 8, 21, 22, 23, 259/24, 122; 366/325, 326, 329, 168, 172, 177, 249, 248, 250, 251, 295, 294

[56] References Cited

U.S. PATENT DOCUMENTS

| | | | |
|---|---|---|---|
| 657,399 | 9/1900 | Day | 366/326 |
| 2,074,673 | 3/1937 | Sackett | 366/137 |
| 2,368,977 | 2/1945 | Fasold | 366/312 |
| 2,578,180 | 12/1951 | Edwards | 241/284 |
| 2,668,694 | 2/1954 | Kline et al. | 366/294 |
| 3,066,831 | 12/1962 | Thompson | 222/185 |
| 3,227,424 | 1/1966 | Cunningham | 366/325 |

*Primary Examiner*—Billy S. Taylor

*Attorney, Agent, or Firm*—Gifford, Van Ophem, Sheridan & Sprinkle

[57] ABSTRACT

Apparatus for continuously mixing sand and binder for foundry use comprises a circular-section housing, a co-axial rotor mounted for rotation in the housing and means for feeding sand and binder to the housing, the housing being of rigid material and blades of the rotor being of resilient material for cooperation therewith.

12 Claims, 4 Drawing Figures

APPARATUS FOR CONTINUOUSLY MIXING SAND AND BINDER FOR FOUNDRY USE

BACKGROUND OF THE INVENTION

I. Field of the Invention

This invention relates to apparatus for continuously mixing sand and binders for a foundry. The apparatus comprises a mixing tube having a substantially vertical axis in which laminar blades are mounted for rotation and blend sand and binders fed from above. In such a so-called turbo-mixer the sand is fed to an atomiser formed by a grooved rotor which atomizes and projects the binders to strike, with a centrifugal movement, the grains of sand falling, and those which might be re-projected upwards by the blades.

The descent of the sand and binders, being relatively rapid, is dependent upon the surmounting of each end of all of the blades which exert substantially on all the particles of sand covered with binder an action which renders homogeneous the distribution of the binder on the particles. The blades extend over the entire internal area of the tube. This means that the blades are obliged to cooperate with the internal surface of the tube.

II. Description of the Prior Art

In the present state of the art, devices for continuously mixing sand and binders for a foundry are known in which the mixing takes place in a device having the form of a turbo-mixer. In these devices of known type it has already been realized that the effectiveness of mixing depends on regulation of the flow of the material or else on the time that the material itself takes to traverse the turbo-mixer and for this blades have been made which extend substantially tranversal of the mixing tube, adapting the surfaces thereof destined to receive the falling material so as to produce a rebound of the grains of sand upwards and thus to retard the descent of the material. These blades having an extension substantially transverse to the axis of the turbo-mixer, while indeed bringing about a slowing down of the material being mixed, were not optimum with regard to the effectiveness of the mixing, that is to say the ratio delay-/effectiveness of mixing was too high. Also in these turbo-mixers, the effectiveness of the mixing was limited because the surfaces destined for this were of limited area. As for the adherence which is necessary to produce the so-called spatulating effect, this had been obtained by forming the body of the turbo-mixer totally or partially of elastic deformable material. This had the defect that the deformations of the container or body of the turbo-mixer were produced by a very limited number of blades and therefore only those blades were producing effective deformations; the others did not produce the deformation but underwent it and therefore did not develop any effectiveness, but even left channels of free passage which accelerated the advance of the material instead of holding it back to homogenize the mixture.

SUMMARY OF THE PRESENT INVENTION

An object of the present invention is to provide a mixer wherein the aforesaid disadvantages are eliminated or reduced and to offer furthermore, various advantages. A further object of the invention is to provide a mixer in which "retro-rebounding" and "spatulating" effects are readily and effectively obtained.

The invention provides apparatus for continuously mixing sand and binder for foundry use, comprising: a housing at whose head is a support which mounts for rotation, an atomizing rotor for the binder and a mixing rotor; supply means for supplying binder to the atomizing rotor and for supplying sand to the mixing rotor; said housing being of circular cross-section and of rigid material, and blades of said mixer being of elastically deformable material.

Preferably the body is constituted by two semi-shells (or half-shells), one of which takes the form of a hinged lid, which can be opened, by rotation through 180° and where the radial free extent of the blades exceeds the radius of the internal surface of the housing body so that constriction of the blades in the restricted limits of the mixing chamber deforms the blades themselves which, thus deformed, develop a spatulating function. The blades preferably lie in planes parallel to the axis of the chamber and thus expose a very reduced surface in the transverse direction whereby the material traverses the mixer in a relatively reduced time. This could appear to be a disadvantage, but is is not, because the effectiveness of the blades in the radial and tangential direction is increased by operating the blades at a velocity greater than the falling of the material. To achieve the same homogeneity of the mixture as with conventional devices production is increased more than 100 percent. Preferably the inlet and outlet blades have extensions respectively turned upwards and downwards. More precisely, the blades of a first set of four can be "L"-shaped, and their free extensions are turned upwards, and when they are constrained or compressed within the body of the turbo-mixer, and rotated they are deformed, assuming, with their upper surface, the configuration of an inclined plane which tends to cause the grains of sand which fall onto them to rebound upwardly. For quite opposite reasons, the set of four outlet blades are also substantially L-shaped, but with free extensions or matching the frusto-conical taper of the outlet mouth of the turbo-mixer, and downwardly extending. These latter blades urge the mixture to leave the turbo-mixer. Therefore with these features, since the delay or slowing-down of the falling material is very reduced, and the effectiveness of mixing very considerable, the ratio of delay/effectiveness of mixing, contrary to what occurs in the known devices, is very reduced.

Furthermore, still unlike the known devices, the spatulating effect is obtained by deforming the blades only, therefore the coupling between each blade and the interval surface of the mixing chamber is always substantially constant.

Finally, the advantage of forming the blades in a laminate of elastomeric material, covered with a lamina of very hard metallic material, for example of steel, offers the advantage of localizing the wear substantially in correspondence with the metallic covering, which can be interchangeable, like the rest of the blades themselves, so that on detecting localised wear it is possible to limit the substitution to the part(s) worn. This is of capital importance for a machine treating a material which has considerable abrasive properties.

Further objects and features of the invention will become apparent from the following description to be read in conjunction with the accompanying drawings.

Figure 1:
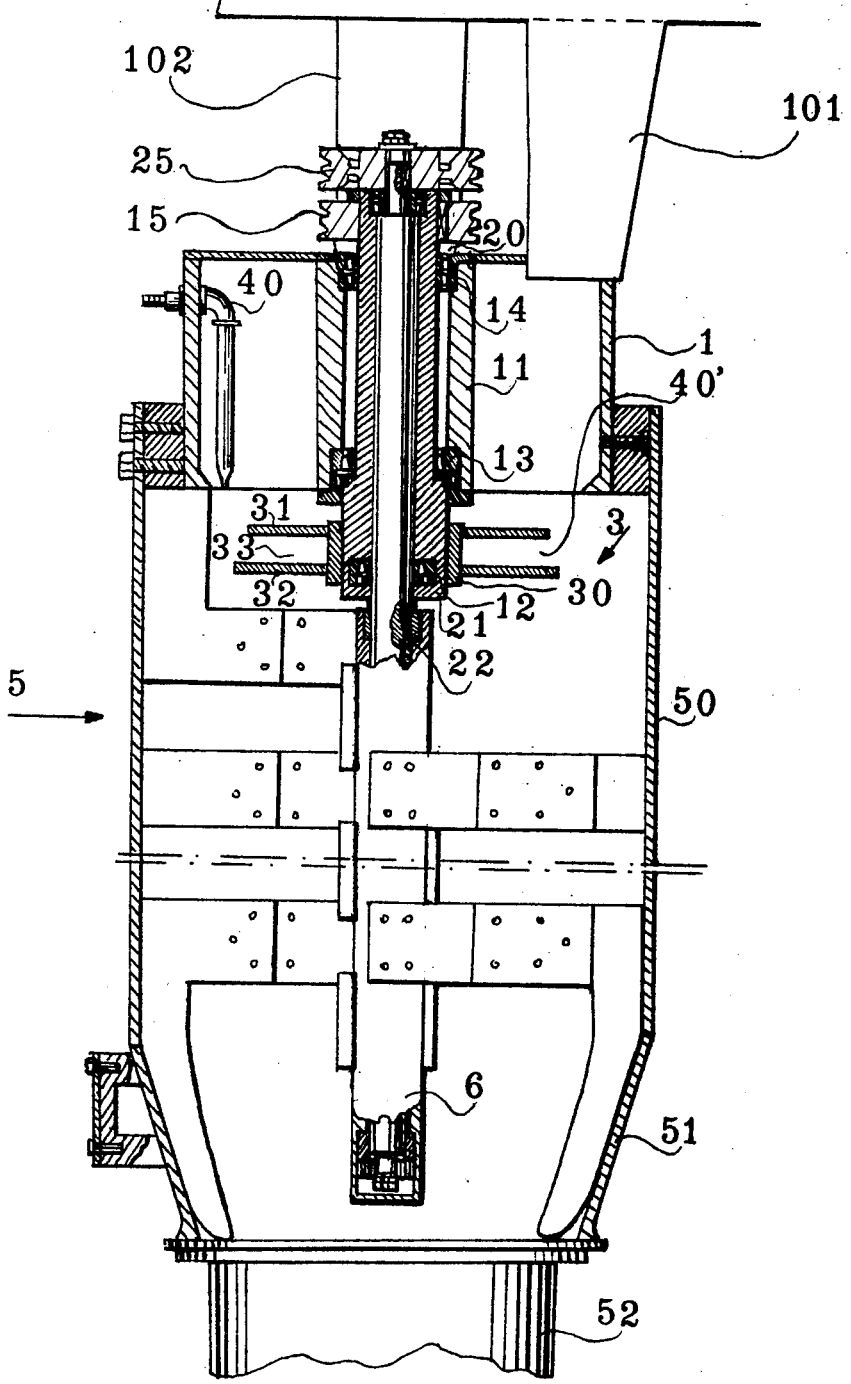
FIG. 1 is a sectional view of the turbo-mixer of the present invention.

With reference to the Figures of the drawings, a turbo-mixer is constituted of a head 1, made in the manner of a housing body, and having in the center a support 11, pre-arranged to bear a pillar 12, on two bearings 13 and 14, which in its turn bears by means of bearings 20 and 21, a long shaft 22, which is extended in cantilever manner substantially to the bottom of the turbo-mixer. Keyed fixedly to the upper end of pillar 12 is a pulley 15, drivable at a relatively high velocity. Keyed fixedly to the upper end of the shaft 22 is a pulley 25, operated at a velocity relatively less than that of the pulley 15. On the lower end of the pillar 12 there is keyed fixedly a rotor or impeller wheel 3, constituted by a hub 30, and by two blades 31 and 32, forming between them a groove or throat 33. From the roof of the housing body 1 there enter two conduits 101 and 102, which have the task of bringing forward into its interior and therefore into the turbo-mixer, the sandy material. From the sides of the housing body 1, or else from diametrically opposed points, there enter two conduits 40 and 40', which end with their outlet mouth, inside the groove 33, where they emit the binder which the rotor atomises and centrifuges. Mounted substantially suspended from the head 1 there is a tubular housing body 5 which in its upper part 50 is cylindrical and in the lower part 51 is frusto-conical, and open downwards where a coupling 52 is applied.

On the cantilever portion of the shaft 22 there is keyed fixedly a core 6, substantially having the form of a parallelepipedon of substantially square section. To this core 6 are applied blades, of elastomeric material, preferably laminated. These blades are arranged in several layers, each layer being formed by a pair of blades, substantially radially, diametrically, and symmetrically opposed, the blades on adjacent levels being displaced by 90° one with regard to the other, each layer overlapping the subsequent one and the preceding one, except of course the top one which overlaps only with the preceding one. The number of blades depends on the dimensions of the apparatus and on the desired productivity.

Figure 2:
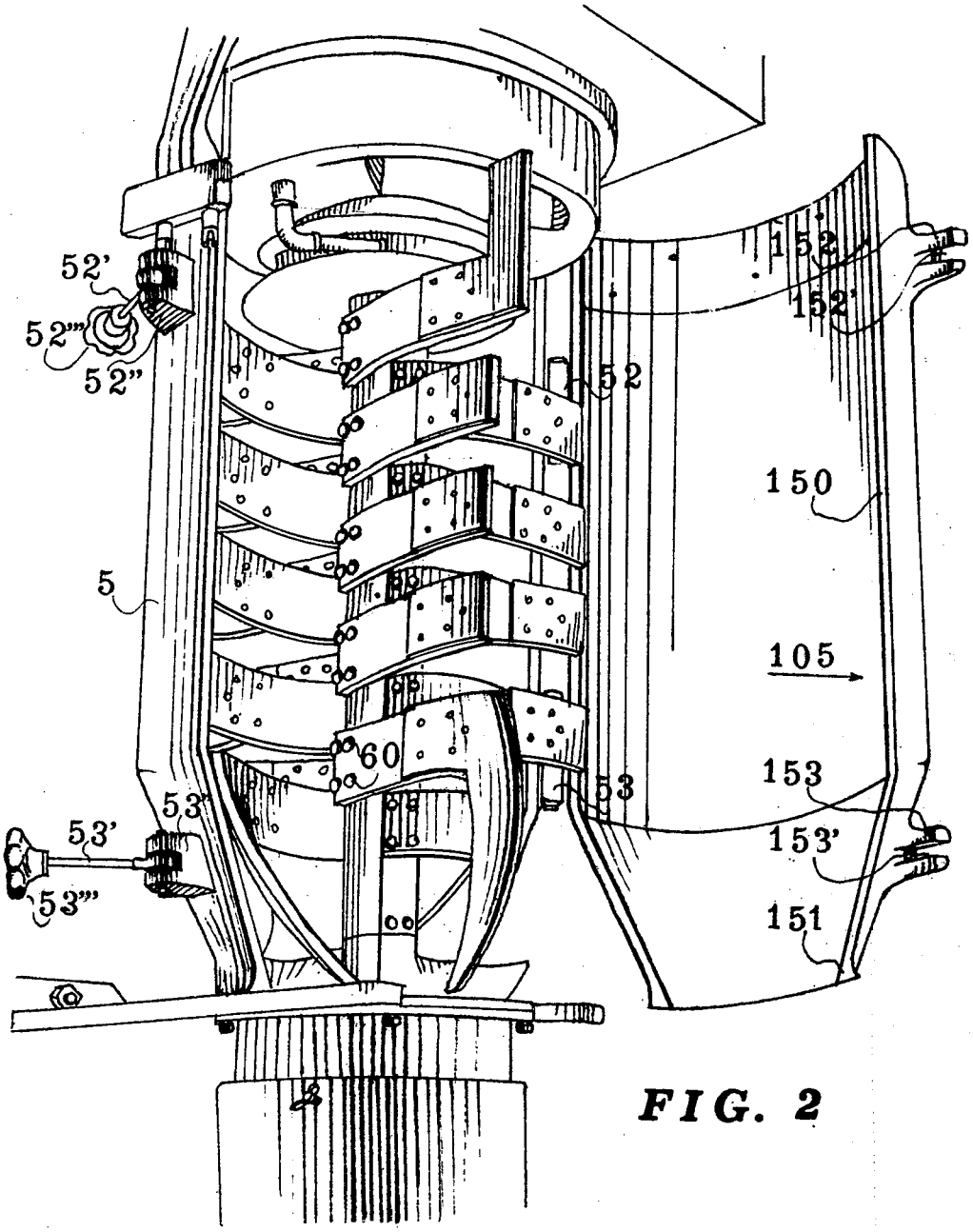
FIG. 2 is a perspective view of the mixer in FIG. 1, with a "door" thereof open.
Figure 3:
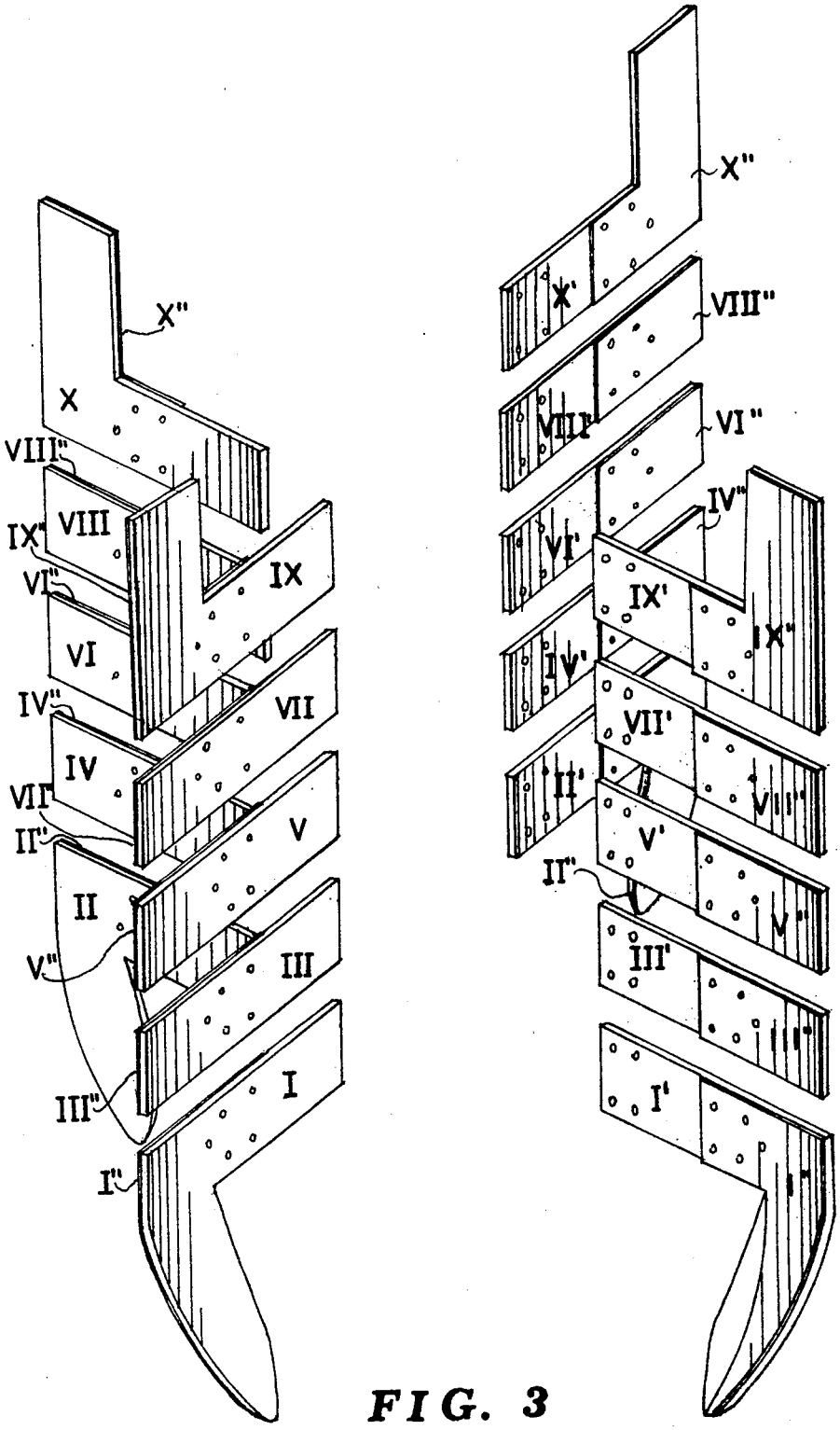
FIG. 3 is an exploded perspective view of the position of the sole blades of the turbo-mixer of the present invention.
Figure 4:
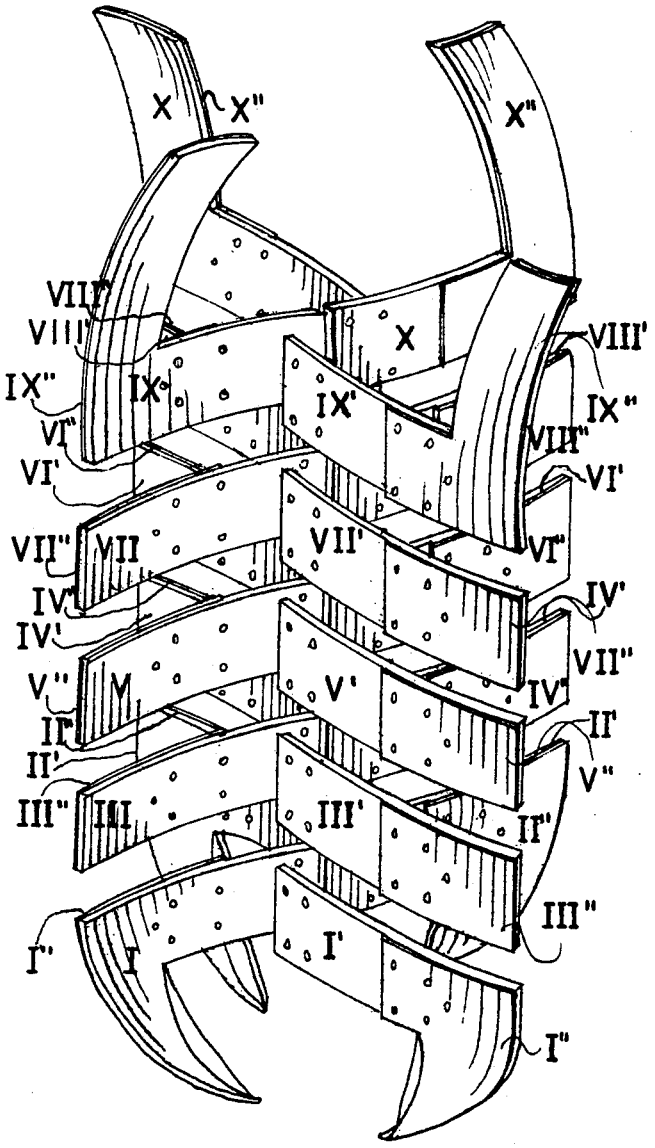
FIG. 4 is substantially a repetition of FIG. 3, but in this Figure the arrangement of the blades is that which is effected when the blades are, not only mounted, but, substantially in operation showing their deformation.

In FIGS. 2, 3, and 4, the arrangement of the blades is in ten layers. More precisely, the six intermediate layers are made of pairs of straight blades as follows: III—III'; IV—IV'; V—V'; VI—VI'; VII—VII'; VIII—VIII'; the two lower layers I—I' and II—II' are each composed of a pair of blades having substantially the shape of a recumbent "L" with a horizontal arm and an arm turned downwards and having an external profile conforming to the taper 51 of the housing body 5 of the turbo-mixer. Also the two upper layers IX—IX'; X—X', are each constituted by a pair of blades having the shape of an "L" with orthogonal arms, the internal surface of the chamber being cylindrical at this point. Unlike the bottom blades, the blades of these last two layers have the longitudinal arms turned upwards. As has been said, the blades shown in FIG. 3 are shown in perpendicular planes, that is to say represented as they are produced, and being produced from a flat laminate, are perfectly flat. In these conditions they are attached to the core 6, with screws 60, (FIG. 2) and their dimensions in the radial directions are such as to exceed the radius of the inner surface of the mixing chamber so that when the nucleus or else the blades are in the mixing chamber, the blades are deformed, bending substantially in an arc, in the manner, so to speak, of a plurality of spatulas. Their mounting is made possible by the fact that the housing body 5 is substantially a semi-shell and the other semi-shell is constituted by the lid 105 (FIG. 2) which like the body 5 is constituted by a cylindrical portion 150 and by a frusto-conical portion 151. The semi-shell lid 105 is hinged at 52 and 53 to the body 5 and, diametrically opposed to the hinges themselves, there are two grips 152 and 153 having respectively a cavity 152', 153', in which there acts respectively a screw 52' and 53'. Each screw 52', 53' is hinged respectively in a support 52'', 53'' integral with the body 5 and on each threaded part 52', 53' there is screwed a knob 52''', 53'''. Therefore, closing the lid, simply with the hands, the body 5 and the lid 105 can be considerably brought nearer, already bringing about an incipient bending of the blades I through X. With the aid of the screws 52' and 53' and of course the knobs 52''' and 53''', there are clamped together in a position of perfect closure the two semi-shells 5 and 105, therefore compelling the blades I–X to assume the dimensions corresponding to the internal surface of the chamber of the turbo-mixer. FIG. 4 of the drawings attempts to show this state of the blades I–X; the state in which the blades or rather their outer ends assume (or are shaped to) the form of spatulas. More precisely the end surfaces which assume such a function are covered with a thin lamina I''–X'', of very hard material, for example UNI-C 72, a steel having a high carbon content.

In accordance with a preferred embodiment of the present invention, the blades are formed from plates of a thickness of 8 or 10 mm of a thermoplastic polyurethane elastomer having the following characteristics:

Shore Hardness=97;
Density=1.19 g/cm$^3$;
Elongation at rupture=400/100;
Rupture load=350 kg/cm$^2$;
Resistance to laceration (or tearing)=150 kg/cm;
Resistance to abrasion=90 mm$^3$;
Resilience=36 o/o;
Ageing in air for 70 hours at 100° C.;
variation in hardness=plus 1 Shore
variation in elongation=0
variation in rupture load=minus 5%
Ageing in oil (ASTM 1) for 70 hours at 100° C.;
variation in hardness=plus 1 Shore
variation in elongation=plus 6%;
variation in rupture load=minus 10%;
variation in volume=0.
Permanent deformation=42% at 70° C.×22 hours.

After what has been described so far, the operation of the turbo-mixer should be simple and obvious. The pulleys 15 and 25 are actuated with rotary motion. More precisely, the pulley 25 is caused to rotate at a number of revolutions less than the number of revolutions of the pulley 15. In fact, the pulley 15 is set to the rotation of the rotor 31 which atomises and centrifuges the liquid binder, which is admitted into its groove throat 33 from the conduits 40, 40', while the pulley 25 is preset to the rotation of the blade I–X of the turbo-mixer. The blades I–X, set rotating, modify slightly their shape. This relates more especially to the blades I, II and IX, X which, so to speak, are screwed in a spiral in the direction of rotation. The spiral screwing of the blades IX and X, evidences inclined surfaces on which the sand which emerges from the tubes 101 and 102 (FIG. 1) by gravity. Therefore, when one sets the machine in motion, one gives at the same time access to the sand from the tubes 101 and 102 (FIG. 1) and to the binder from the tubes 40 and 40'. Part of the sand which falls on the blades IX and X is re-projected upwards, part is struck by the atomized particles of binder projected by the rotor 31, 32, another part of particles which have already passed once or twice in front of the rotor 30 is spatulated and dissolved by the spatulas IX and X and by the subsequent lower ones on which it falls and finally, a final part passes at once under the action of the lower rotors, being dissolved and spatulated by these, until reaching the chamber 51 where the ramifications of the blades I and II, they too screwed, tends to expel the homogenized sand.

It is preferable for the rotor 30, and therefore the pulley 15, to rotate in the opposite direction to the blades, or to their pulleys 25.

In the foregoing description, the invention has been described and shown merely by way of example and not restrictively. Therefore it stands to reason that numerous modifications can be made to its whole and to its details by those skilled in the art, without however departing from the basic principles on which the present invention is based.

I claim:

1. Apparatus for continuously mixing sand and binder for foundry use comprising;

a housing having a head, said housing being constructed of a rigid material and having a circular cross-sectional shape, a support secured to said housing head. wherein said housing is hollow and defines a mixing chamber, an atomizing rotor and a mixing rotor rotatably mounted to said support in said mixing chamber, supply means for supplying binder to the atomising rotor and for supplying sand to the mixing rotor, and said mixing rotor having a plurality of blades constructed of an elastically deformable material, wherein at least one of said blades is covered with a lamina of very hard wear resistant material having a thickness of about 1/10th the thickness of the blade.

2. Apparatus as set forth in claim 1, wherein said blades are arranged in three or more layers.

3. Apparatus as set forth in claim 2, wherein said blades are mounted on a shaft having a substantially square section, each said layer comprising a pair of substantially identical blades, said blades being positioned on opposite surfaces of said shaft and substantially coplanar with said shaft.

4. Apparatus as set forth in claim 2, wherein said blades of each said layer have a radial disposition orthogonal to the blades of the preceding and/or subsequent layer and are disposed at a level such that the field of action of said blades of each said layer interferes with the field of action of the blades of the preceding and subsequent layer.

5. Apparatus as set forth in claim 1, wherein all said blades are of such length that once mounted on said shaft, the radial extent of said blades is greater than the radius of the housing in which they act when said blades are in the straight original undeformed state.

6. Apparatus as set forth in claim 2, wherein at least one of the blades of the upper layers is L-shaped where one limb of the "L" bears on the internal surface of the housing and extends upwards.

7. Apparatus as set forth in claim 6, wherein the L-shaped blades whose free limbs extend upwardly are four in number and situated in the two upper layers.

8. Apparatus as set forth in claim 2, wherein at least one of the blades of the lower layers has the longitudinal form of an "L" where one limb of the "L" shaped blade contacts the internal surface of the housing and extends downwardly.

9. Apparatus as set forth in claim 8, wherein there are four blades provided with downwardly, extending limbs, said last mentioned blades being situated in the two lower layers.

10. Apparatus as set forth in claim 1, wherein the blades are of a laminate of a thermoplastic polyurethane elastomeric material having the following characteristics:

Shore Hardness=97;
Density=1.19 g/cm$^3$;
Elongation at rupture=400/100;
Rupture load=350 kg/cm$^2$
Resistance to laceration=150 kg/cm;
Resistance to abrasion=90 mm$^3$;
Resilience=36%;
Ageing in air for 70 hours at 100° C.;
Variation in hardness=plus 1 Shore;
Variation in elongation=0
Variation in rupture load=minus 5%;
Ageing in oil (ASTM 1) for 70 hours at 100° C.;
Variation in hardness=plus 1 Shore;
Variation in elongation=plus 6%;
Variation in rupture load=minus 10%;
Variation in volume=0;
Permanent deformation=42% at 70° C.×22 hours.

11. Apparatus as set forth in claim 1, wherein the housing further comprises two semi-shells, one of which acts substantially as a casing and the other, hinged longitudinally to the first one, acts as a lid and can be opened through an angle of 180°.

12. Apparatus as set forth in claim 11, wherein the housing is tapered at its lower portion, and wherein said blades acting in said tapered lower portion conform to the shape of the housing.

* * * * *